US005690245A

United States Patent [19]

Jenkins

[11] Patent Number: 5,690,245

[45] Date of Patent: Nov. 25, 1997

[54] FOOD TRAY

[76] Inventor: Donald E. Jenkins, 1920 Howell Mill Dr., Chattanooga, Tenn. 37421

[21] Appl. No.: 611,095

[22] Filed: Mar. 5, 1996

[51] Int. Cl.[6] ..... B65D 21/024

[52] U.S. Cl. ..... 220/23.4; 220/23.86

[58] Field of Search ..... 220/23.4, 23.83, 220/23.86; 206/504

[56] References Cited

U.S. PATENT DOCUMENTS

| | | | |
|---|---|---|---|
| 3,384,260 | 5/1968 | Buffington . | |
| 3,526,334 | 9/1970 | Ashton et al. | 220/238.3 |
| 3,799,386 | 3/1974 | Madalin et al. . | |
| 3,994,109 | 11/1976 | Holz . | |
| 4,483,455 | 11/1984 | Prophet, Jr. et al. . | |
| 4,599,314 | 7/1986 | Shami | 220/23.4 |
| 4,938,373 | 7/1990 | McKee . | |
| 4,966,296 | 10/1990 | Farrell . | |
| 4,968,625 | 11/1990 | Smith et al. | 220/23.4 |
| 4,986,432 | 1/1991 | Anghileri | 220/23.4 |
| 5,423,449 | 6/1995 | Gordon et al. . | |

FOREIGN PATENT DOCUMENTS

| | | | |
|---|---|---|---|
| 1216771 | 5/1966 | Germany | 220/23.4 |
| 618891 | 3/1961 | Italy | 220/23.4 |

*Primary Examiner*—Stephen J. Castellano
*Attorney, Agent, or Firm*—Chase & Yakimo

[57] ABSTRACT

A food tray comprising a frame having a plurality of apertures therein. The apertures generally correspond to the configuration of the respective food container to be engaged therein. Each food container has a pair of parallel ridges extending about its perimeter so as to present a slot therebetween. The slot of each container engages the portions of the frame which define each aperture. Each food container is thus releasably engageable with the frame. The tray enables a plurality of initially separate containers to be separately heated and/or chilled prior to releasable engagement with the frame.

8 Claims, 6 Drawing Sheets

FOOD TRAY

BACKGROUND OF THE INVENTION

This invention relates to a food tray and, more particularly, to a food tray having a plurality of food containers releasably engageable thereto.

The use of a food tray for storing different foods therein is known. One example is the tray commonly found in a frozen food dinner, such food tray being insertable in a conventional or a microwave oven for food heating. One problem with such a tray is that the entire tray must be inserted into the microwave or conventional oven at the same time. In such cases, absent special handling, the different food items in the tray will be heated at the same temperature and/or for the same period of time. Thus, in some instances some of the food products need to be uncovered, e.g. the dessert, while the others need to be covered, e.g. the meat products. Accordingly, it is desirable to have a food tray having individual food containers removable therefrom. The individual containers can then be separately heated or chilled depending on the food contents stored therein.

In response thereto I have invented a food tray comprising a frame having a plurality of orifices therein. The portions of the frame about the orifices engage a slot extending about correspondingly shaped containers in a snap fit relationship therebetween. The individual containers are individually removable from the frame so that the food therein can be independently stored, heated and/or chilled.

It is therefore a general object of this invention to provide a food tray enabling one to jointly or severally heat and/or chill the food elements placed therein.

Another object of this invention is to provide a tray, as aforesaid, having a plurality of apertures therein for releasably engaging similarly shaped food containers.

A further object of this invention is to provide a food tray, as aforesaid, the containers having structure for releasable engagement within the confines of the food tray apertures.

A more particular object of this invention is to provide a food tray, as aforesaid, which enables the user to individually choose, heat or cool the containers to be engaged with the food tray.

It is a further object of this invention to provide a food tray, as aforesaid, which spaces apart the engaged containers so as to diminish any heat transfer therebetween.

Another particular object of this invention is to have a food tray, as aforesaid, wherein the food tray can be easily supported atop an underlying surface.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
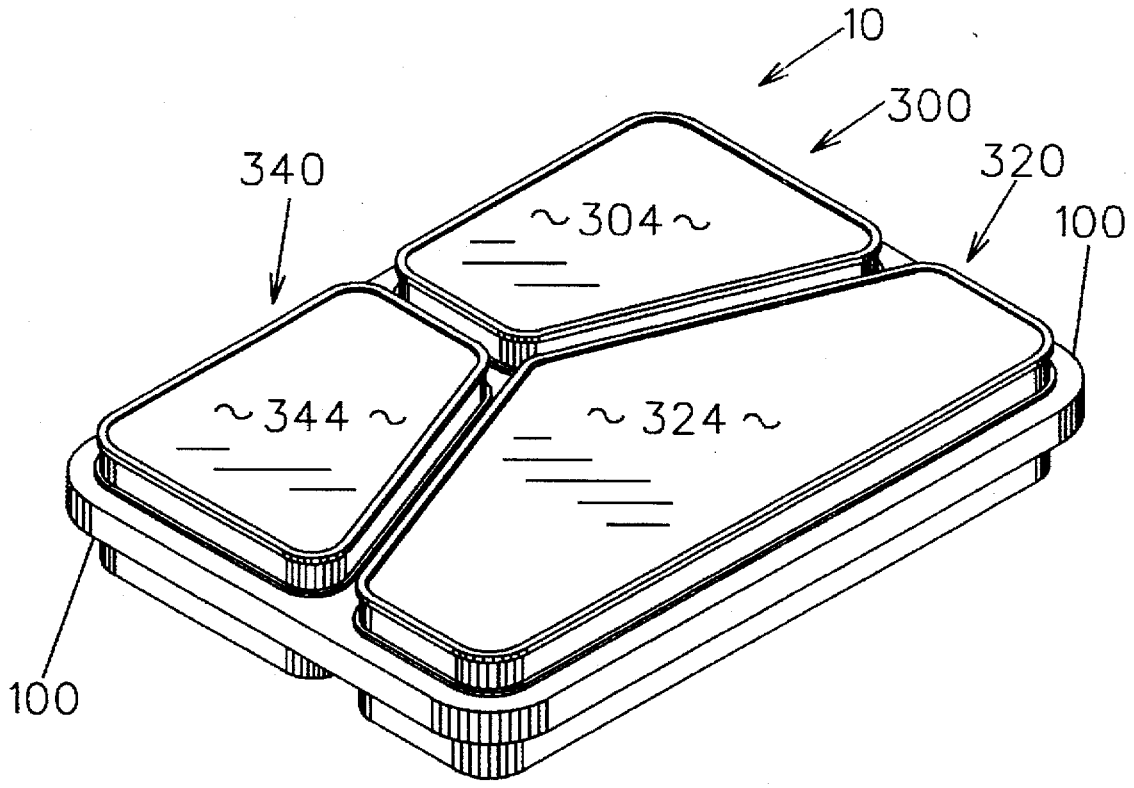
FIG. 1 is a perspective view of my food tray.
Figure 2:
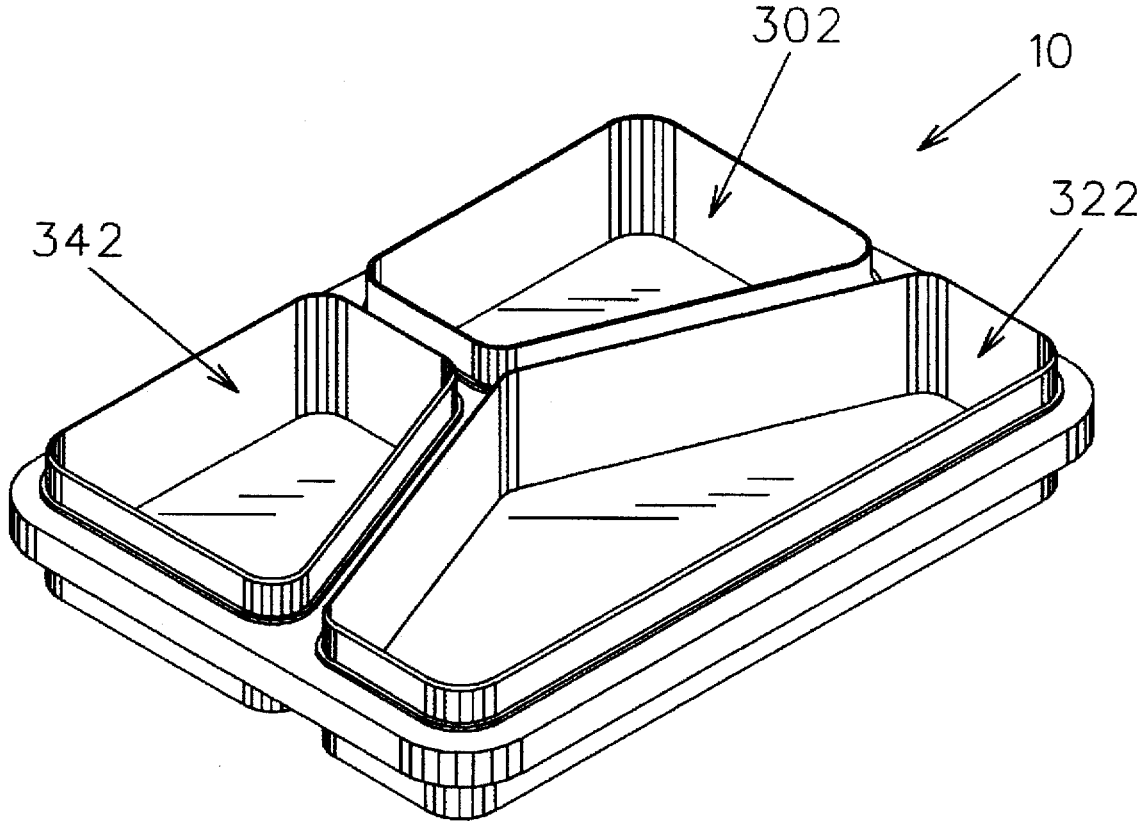
FIG. 2 is a perspective view of the food tray of FIG. 1 with the lids removed.
Figure 3:
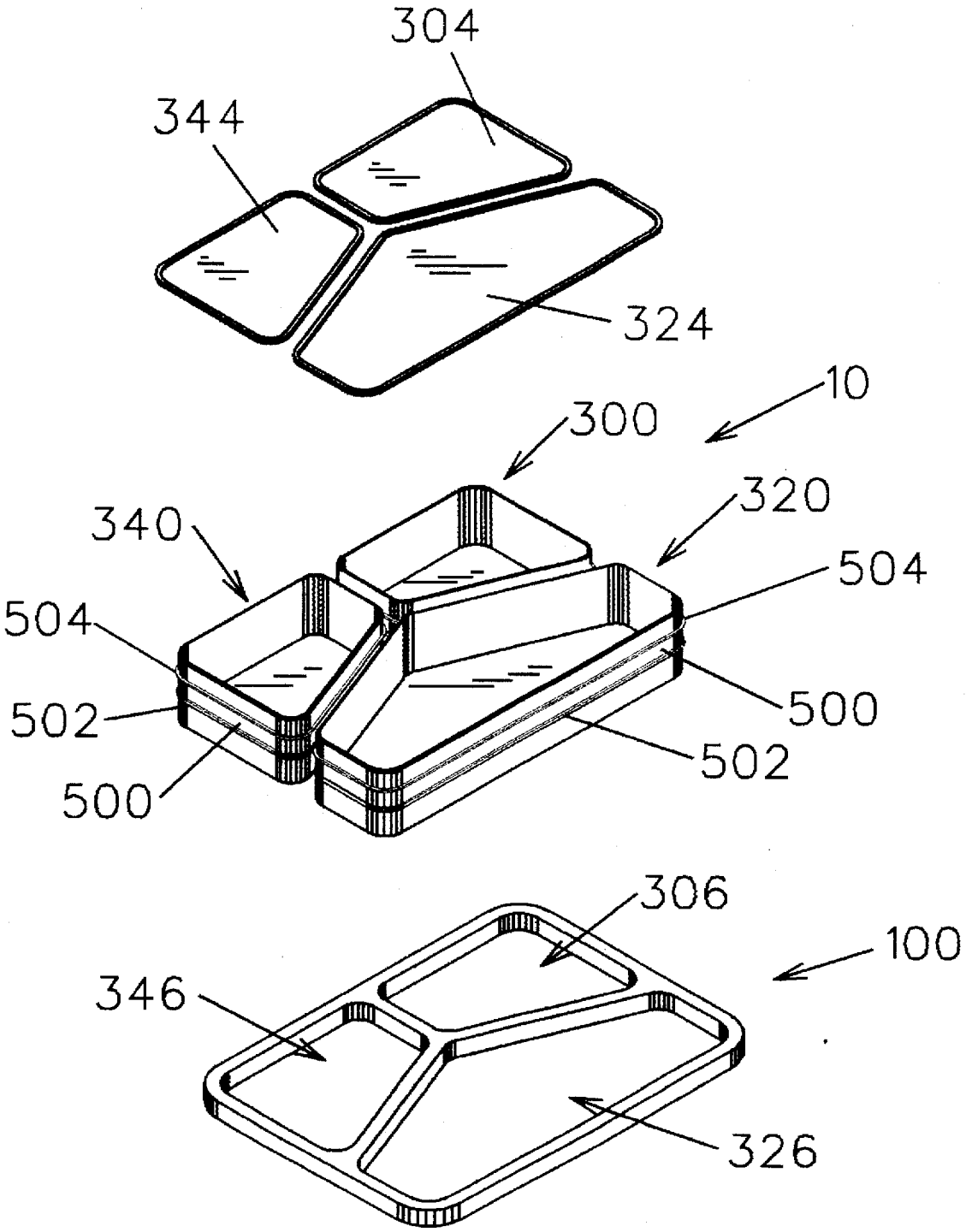
FIG. 3 is an exploded view of the elements of the food tray of FIG. 1.
Figure 4:
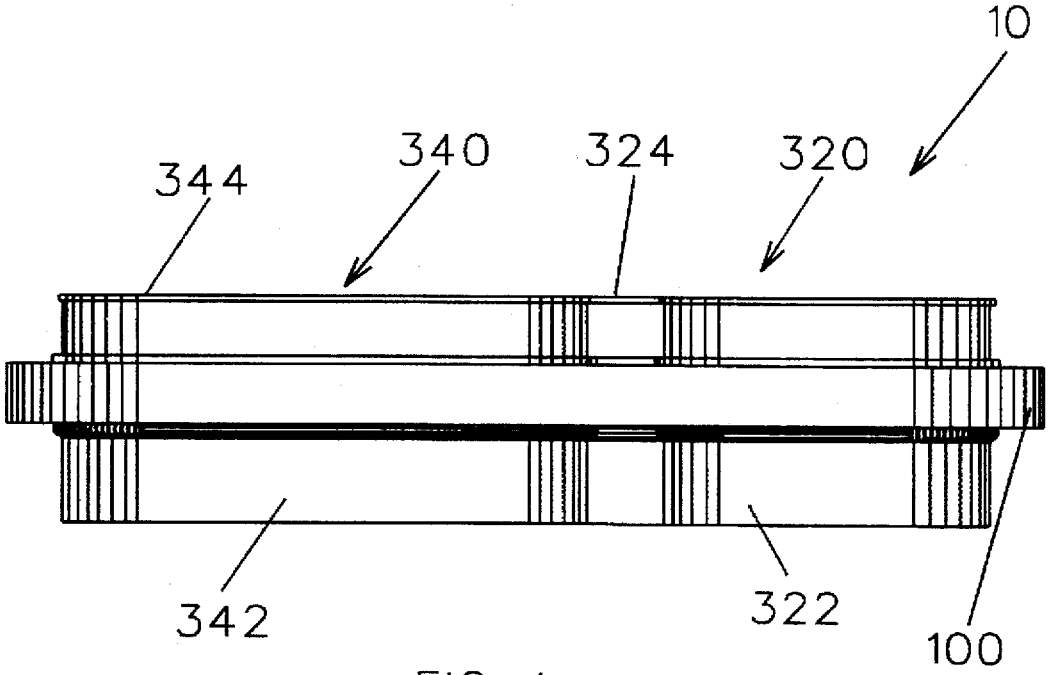
FIG. 4 is a left side view of the food tray of FIG. 1 on an enlarged scale.

FIG. 1 generally illustrates the tray 10 as comprising a generally rectangular frame 100 having a plurality of variously configured food containers 300, 320 and 340 therein. Each container includes a storage portion 302, 322 and 342 covered by removable lids 304, 324 and 344. As shown in FIG. 3, the tray 10 includes a plurality of apertures 306, 326 and 346, the configuration of these apertures being generally congruent to the configurations of the respective food containers 300, 320, 340.

Figure 5:
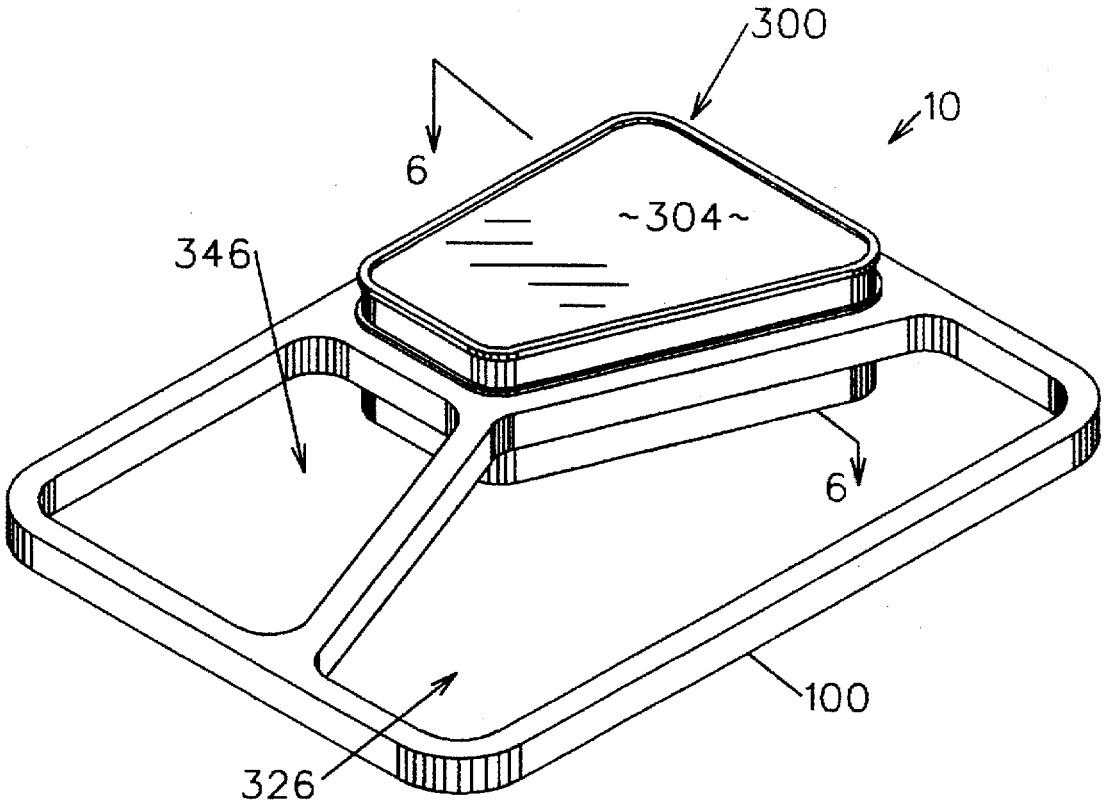
FIG. 5 is a perspective view of the food tray of FIG. 1 with two of the food containers removed and one container remaining in place.
Figure 6:
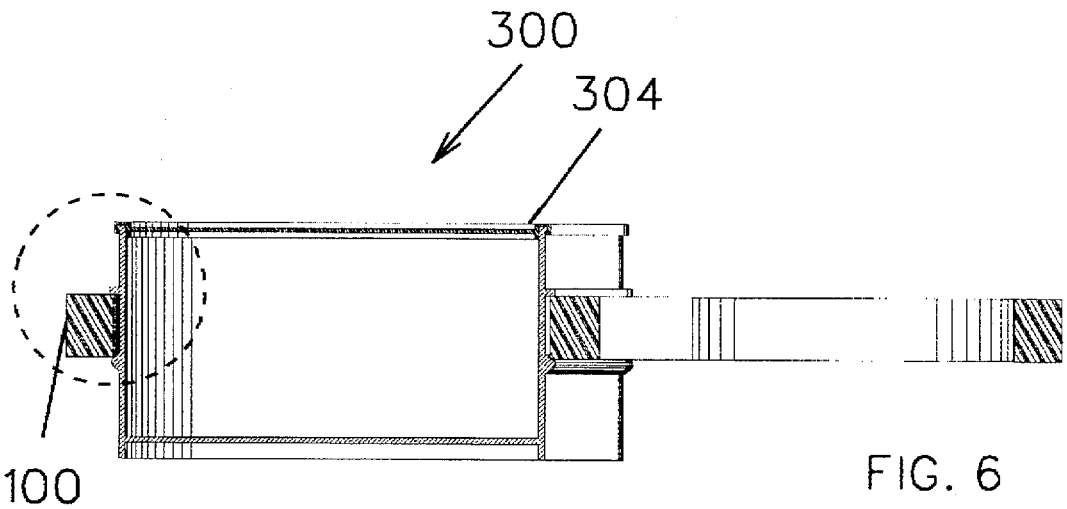
FIG. 6 is a cross sectional view of the food tray of FIG. 5, taken along line 6—6.
Figure 7:
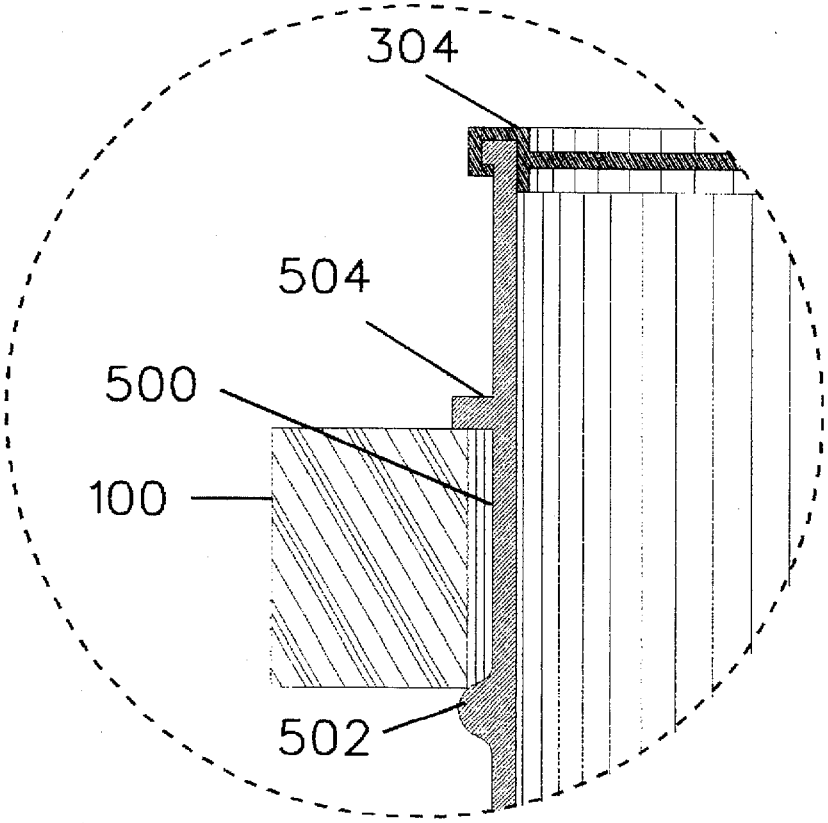
FIG. 7 is a fragmentary view, on an enlarged scale, showing the engagement between a portion of the frame of the food tray and the food container.

As shown in FIGS. 3, 6 and 7, each container 300, 320, 340 has a groove/slot 500 extending about the vertical walls defining the container configuration. The slot 500 is defined by a first lower ridge 502 and a second upper ridge 504. The slot 500 engages via a releasable snap-fit relationship the portion of the frame 100 defining the respective aperture which is to receive the particular container therein. The slot 500 on each container is preferably the same distance from the bottom surface of each container. Accordingly, upon all containers engaging the tray 10 the lower surfaces of the engaged containers will be in a common plane allowing the tray 10 to be placed on an underlying planar surface, e.g. a table, without wobbling or the like. The lower ridge 502 stops the frame 100 from being positioned beyond the slot 500. Upper ridge 504 further maintains the respective container in place. As best shown in FIG. 7, the lower 502 and upper 504 ridges engage the lower and lower and upper surfaces of the frame 100. Thus, each food container may be separately inserted into the frame 100 or removed therefrom as shown in FIG. 5.

The ability of the frame 100 to releasably engage the various food containers allows the food contents therein to be separately heated and/or chilled. Moreover, the portion of the frame 100 defining the aperture separates the containers during their engagement in the frame 100. This displacement diminishes the occurrence of any significant heat transfer between the containers. Accordingly, the heated foods will not transfer heat to any chilled food, such as fruit, ice cream, etc.

Accordingly, my food tray 10, as above described, presents a variety of options including the options of heating, storing and chilling the various food elements to be served. Moreover, in a cafeteria environment, each of the containers may be heated and/or chilled according to the food therein and separately stored along the cafeteria line. A person walking through the cafeteria line need only pick up the desirable containers and snap fit them into the appropriate tray aperture. Thus, all the food containers need not be chosen which will reduce any unnecessary food waste. Moreover, the various container shapes will aid in identifying the food contents therein even when the respective lids are in place.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A food tray comprising:

a frame having a plurality of apertures therein;

a food container for placement within each aperture, each container having an opening at a top end and a base with a vertical wall extending between said opening and said base, the extent of said vertical wall between said opening and base having a configuration generally congruent to the shape of the respective aperture;

an upper ridge about said vertical wall and extending therefrom, said upper ridge vertically displaced from said opening to present a portion of said vertical wall extending between said opening and said upper ridge;

a lower ridge about said vertical wall and extending therefrom, said lower ridge vertically displaced from said upper ridge with a second portion of said vertical wall extending between said ridges and combining therewith to present a slot about said vertical wall of each container for releasably engaging a portion of said frame defining each respective aperture therein, said upper and lower ridges precluding a displacement of said engaged frame portion along said sidewall, whereby a plurality of food containers are releasably engageable with said frame.

2. The tray as claimed in claim 1 wherein each slot on each container is generally equidistant from a bottom surface of each container.

3. The tray as claimed in claim 1 wherein said upper and lower ridges engage upper and lower surfaces of said frame.

4. The tray as claimed in claim 1 wherein each container includes a releasable lid.

5. The tray as claimed in claim 1 wherein each of said apertures are separated by a portion of said frame.

6. The tray as claimed in claim 1 wherein said frame is generally planar.

7. The tray as claimed in claim 1 wherein said upper ridge presents a generally planar surface for contact with a top surface of said portion of said engaged frame adjacent said corresponding aperture, said ridge tracing a configuration of said aperture and extending therebeyond to preclude a downward displacement of said container through said aperture upon said engagement of said frame portion in said slot.

8. The tray as claimed in claim 7 wherein said lower ridge comprises a generally downwardly sloping surface extending from said sidewall for contact with a lower surface of said frame surrounding said corresponding aperture upon said engagement, said lower ridge precluding a downward displacement of said engaged frame portion beyond said lower ridge and out of said slot.

* * * * *